United States Patent [19]

Arbter

[11] 4,068,603

[45] Jan. 17, 1978

[54] APPARATUS FOR FEEDING MATERIAL FOR FORMING A DOUBLE TUCK ON THE CUT EDGES THEREOF

[76] Inventor: Conrad Arbter, Mittelweg 9, Saal an der Saale, Germany, 8741

[21] Appl. No.: 723,229

[22] Filed: Sept. 15, 1976

[30] Foreign Application Priority Data

Oct. 3, 1975 Germany ..... 2544409

[51] Int. Cl.[2] ..... D05B 19/00; D05B 35/04; D05B 27/08

[52] U.S. Cl. ..... 112/121.11; 112/147; 112/203; 112/208; 112/215; 112/262

[58] Field of Search ..... 112/147, 152, 141, 136, 112/121.11, 121.27, 121.12, 208, 209, 215, 203, 262

[56] References Cited

U.S. PATENT DOCUMENTS

| | | | |
|---|---|---|---|
| 1,071,108 | 8/1913 | Stedman | 112/208 |
| 2,965,056 | 12/1960 | Wallenberg et al. | 112/208 |
| 3,277,851 | 10/1966 | Dobner et al. | 112/147 X |
| 3,463,482 | 8/1969 | Baron et al. | 112/147 X |
| 3,867,889 | 2/1975 | Conner, Jr. | 112/121.11 |
| 3,898,941 | 8/1975 | Crawford et al. | 112/147 X |

*Primary Examiner*—H. Hampton Hunter
*Attorney, Agent, or Firm*—McGlew and Tuttle

[57] ABSTRACT

An apparatus for forming a double tuck on a lateral edge of a length of material web comprises a U-shape folding bar for supporting the material at a spaced location from the edge of the material and which includes a lower leg and an upper leg interconnected by a web or yoke. A stave is mounted for upward and downward motion adjacent the folding bar in a plane spaced from the yoke portion by the thickness of the web and being movable downwardly for folding the lateral edge about the yoke portion. A fold slide is mounted for transverse movement in a plane adjacent to and spaced from the lower leg by the thickness of the web and it is movable toward the lower leg for folding the lateral edge against the lower surface of the lower leg. A folding plate is mounted for upward and downward movement in a plane adjacent to and spaced from the lower leg by the thickness of the web in order to tuck over the edge of the material around the edge of the leg and it is movable transversely parallel to the plane of the lower leg and in a plane spaced above the lower leg by the thickness of the web in order to form the bottom tuck of the material. A first conveyor belt is arranged to move along the fold slide and is engageable against the bottom of the material and a second conveyor is mounted above the folding bar and is engageable with the top of the material and the first and second conveyors operate together to advance the material into association with the sewing needle. In addition, there is at least one auxiliary feed means in the form of a movable feed plate which engages the material at the bottom face thereof directly adjacent the tucked over portion and to feed it at a different linear speed than the remaining portion of the web in order to maintain the alignment of the folded edge with the remaining length of the material web.

12 Claims, 9 Drawing Figures

APPARATUS FOR FEEDING MATERIAL FOR FORMING A DOUBLE TUCK ON THE CUT EDGES THEREOF

FIELD AND BACKGROUND OF THE INVENTION

This invention relates in general to a device for feeding material in sewing machine installations and, in particular, to a new and useful device for forming a double tuck at the cut edges of a flat material web and for feeding the material web to a sewing station.

DESCRIPTION OF THE PRIOR ART

Systems for forming a double tuck on a material web are known, wherein at the lateral edges of the material web supplied to a sewing station by feed means, fixed folding sockets with helical guide faces are arranged, by which the opposite edge strips of the material web passed through the folding sockets are folded over to one side and are then fixed by seams. As the edge strips are folded over obliquely to the shifting direction and the feed means, designed as conveyor belts, must be arranged spaced alongside the fold portion, this kind of tuck formation results in a distortion of the edge strips of the material webs in the longitudinal direction, with the result that the double tucked portion of the edge strip does not end flush with the rear edge of the material web seen in the feed direction, but protrudes over it, and thus impairs the appearance of the workpiece.

To avoid this disadvantage, it has heretofore been proposed to tuck the edge strips of a material web to be double tucked simultaneously along the entire web length by means of movable folding tools cooperating with a fixed folding bar, and to deflect the web about a fold-line parallel to the cut edge. This method, however, has the disadvantage that the fold-slide applying against the tuck side in the fold end position does not permit the use of pairs of cooperating feed devices, for example, conveyor belts, to clamp the tuck portion from both sides between them before the sewing station. Only an upper feed means can be used, except that at a location just before the sewing station, oppositely disposed pairs of cooperating feed devices which clamp the tuck zone of the material web in a plier fashion can be used. A distortion in the longitudinal direction of the material web cannot fail to occur, so that the double tucked edge strip of the material web again protrudes over the rear web edge.

The longitudinal distortion of the tuck described is supported by the fact that, in pulling the material web off of a supply roll, a certain longitudinal distortion or longitudinal straining of the material web cannot be avoided entirely. Moreover, when the individual workpieces are cut in lengths by a crosscutting device, a dynamic pressure directed normal to the longitudinal direction of the material web in the direction of movement of the cutting tool acts, particularly in the case of blunt cutting tools, on the material web, whereby, it also suffers a certain transverse distortion in the zone of the cut edges then to be tucked. All this together has a result that the cut edges to be tucked at the rear edge of the workpiece in respect to the feed direction will, after the cross-cutting, protrude over the rear edge of the material web; which, through the transversely directed dynamic pressure, is slightly deformed concavely, so that the double tuck will not lie flush with the rear workpiece edge, but rather will extend beyond it.

SUMMARY OF THE INVENTION

The present invention provides a device in which the tuck zone of a material web is transported to the sewing station while it is gripped in plier fashion, and the double tucked portions of the edge strip are supplied to the sewing station and are stitched in a manner to end flush with the edge of the material web away from the sewing station.

In accordance with the invention, the device includes a conveyor belt engaging at the tuck portion of the material web which is displaceable jointly with the fold-slide, and an additional feed is provided to engage at the tuck portion of the material which is driven briefly and faster than the conveyor belts.

In this arrangement, the section of the conveyor belt engaging at the tucked edge strip of the material web is used at the same time as an active folding element and, by the use of the additional feed means engaging at the tuck portion and driven briefly and faster than the conveyor belts, the portions of the tuck protruding over the terminal edge of the material web are brought into a position ending flush with the edge, so that the good appearance of the finished sewn workpiece is not impaired.

A particularly simple design for avoiding the protrusion of the tuck over the rear edge of the material web results from the fact that the feed means is an auxiliary feed plate which, together with its drive device, is arranged at the fold slide and executes a quadrangular movement in a vertical plane and is movable through a cutout in the fold slide in engagement with that portion of the tuck of the material web which is folded around the lower leg of the U-shaped folding bar.

To avoid a lateral yielding of the section of the conveyor belt engaging at the tuck portion when the first fold of the tuck is being formed, the upper section of the conveyor belt is guided in a slot in the fold slide. A faulty insertion of the inner tuck portion between the legs of the U-shape folding bar is avoided by the fact that the insertion movement of the fold plate into the U-shape portion of the folding bar occurs several times in succession during a tuck formation.

Accordingly, it is an object of the invention to provide a device for forming a double tuck on a lateral edge of a length of flat material web which comprises a U-shape folding bar for supporting the web which includes horizontally disposed upper and lower legs interconnected by a yoke or web portion and includes a stave which is mounted to move downwardly alongside the material to fold the material about the yoke portion, and also includes a slide which is mounted for transverse motion in a plane adjacent to and spaced from the lower leg by the thickness of the web in order to deflect the material against the lower surface of the lower leg and which also includes a folding plate which is mounted to move upwardly to engage the remaining edge of the material and to deflect it around the edge of the lower leg and to move laterally to tuck the remaining length into the space between the upper and lower legs and further includes conveyor belts which engage the material from the top and bottom for advancing it into association with the sewing needle and a separate feed mechanism which is engageable with the web material adjacent the portion thereof which is folded around the lower edge of the folding bar in order to advance this material at a speed, for example, a faster speed, than the remaining operating feed conveyor for maintaining alignment of the folded lateral edge of the material.

A further object of the invention is to provide an apparatus for feeding material into association with a sewing needle which is simple in design, rugged in construction and economical to manufacture.

For an understanding of the principles of the invention, reference is made to the following description of a typical embodiment thereof as illustrated in the accompanying drawings.

DESCRIPTION OF THE PREFERRED EMBODIMENT

Figure 1:
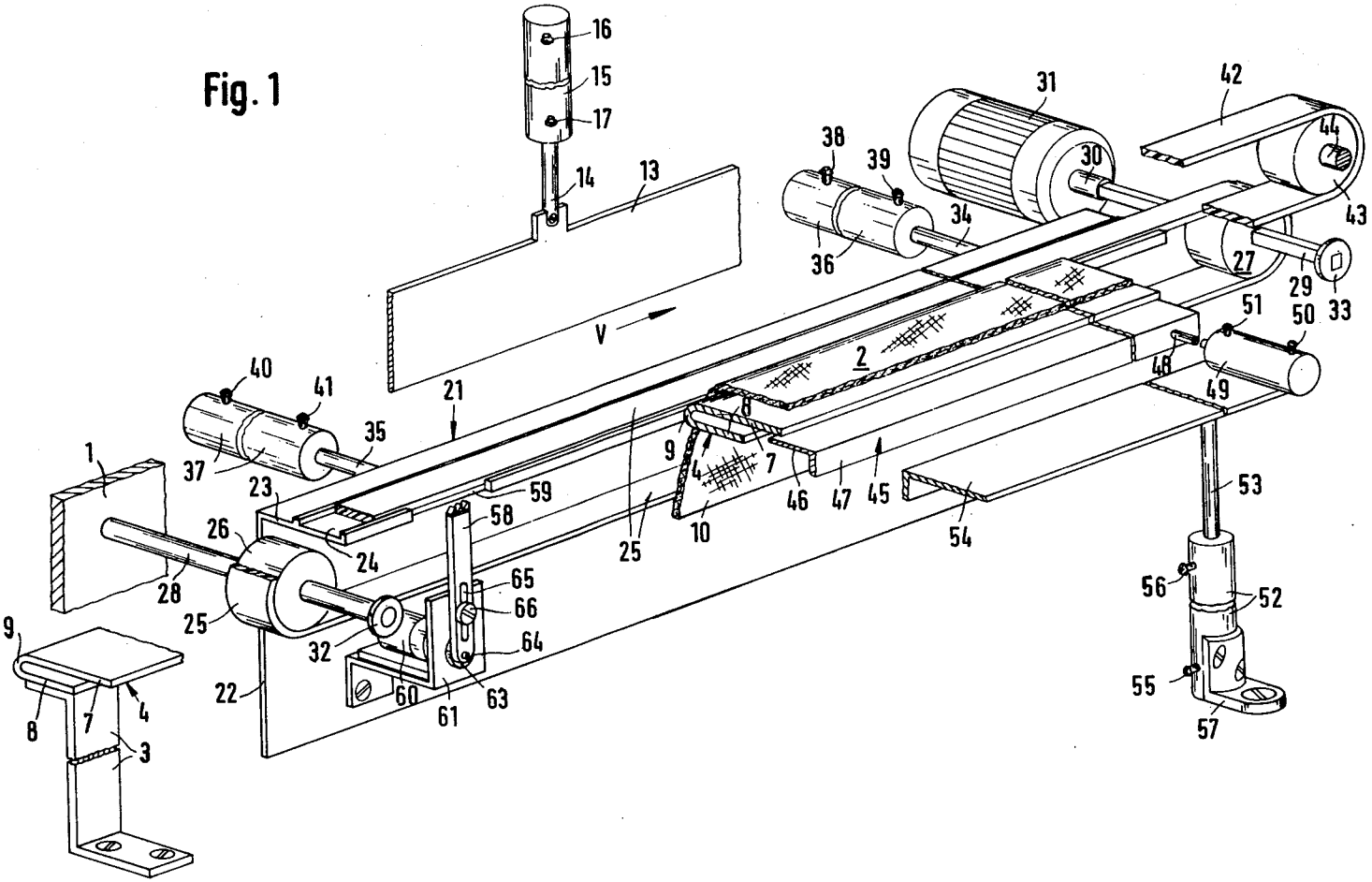
FIG. 1 is a partial schematic perspective view of a sewing machine system having feeding devices for forming and advancing a material having a double tuck constructed in accordance with the invention.
Figure 2:
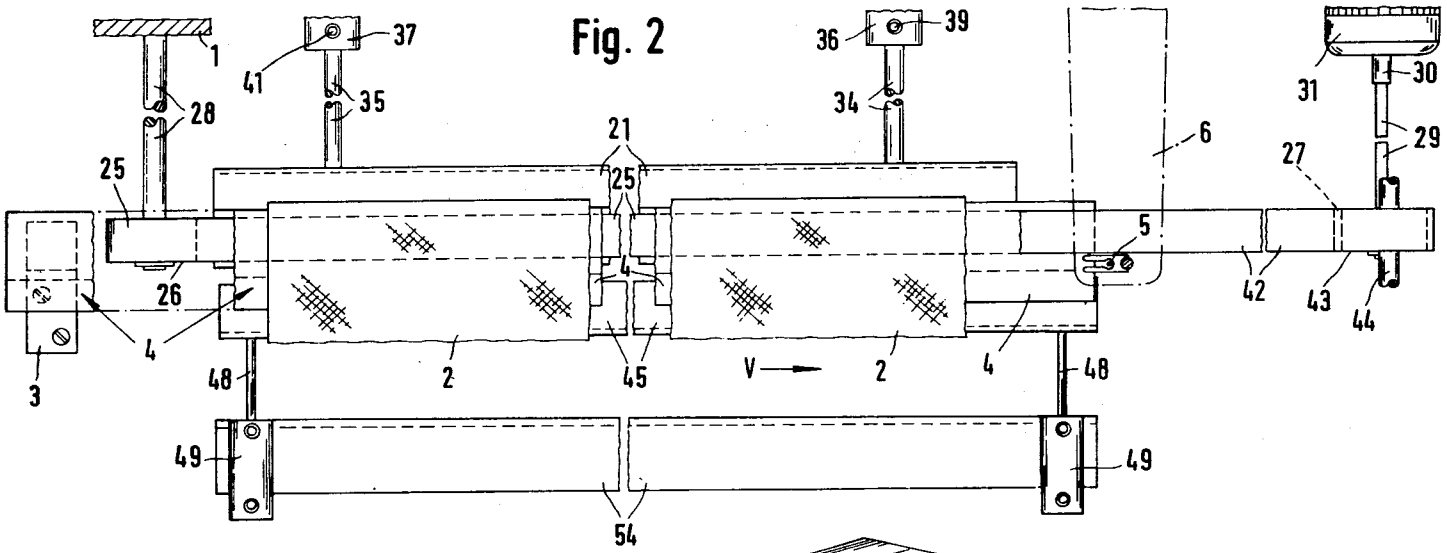
FIG. 2 is a partial top plan view of the mechanism shown in FIG. 1.
Figure 9:
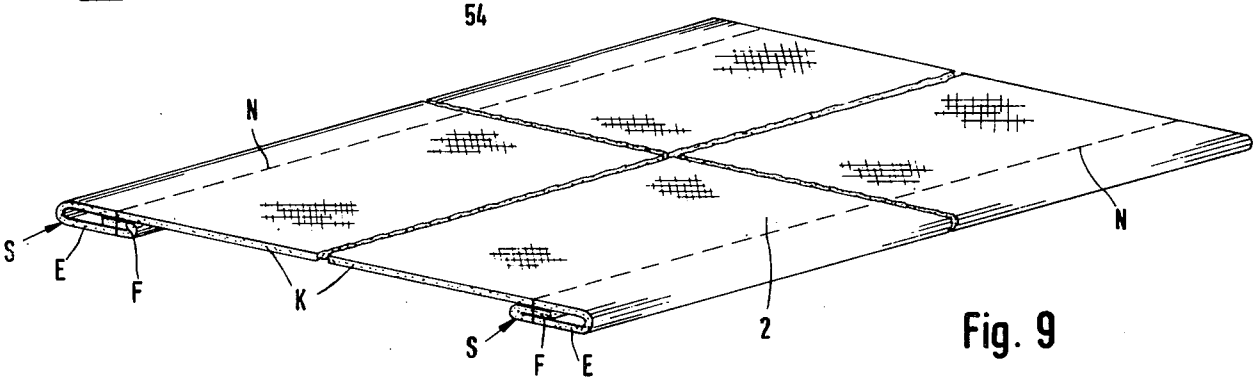
FIG. 9 is a perspective view of a finished workpiece having two lateral edges with a double tuck formed and sewn together.
Figure 7:
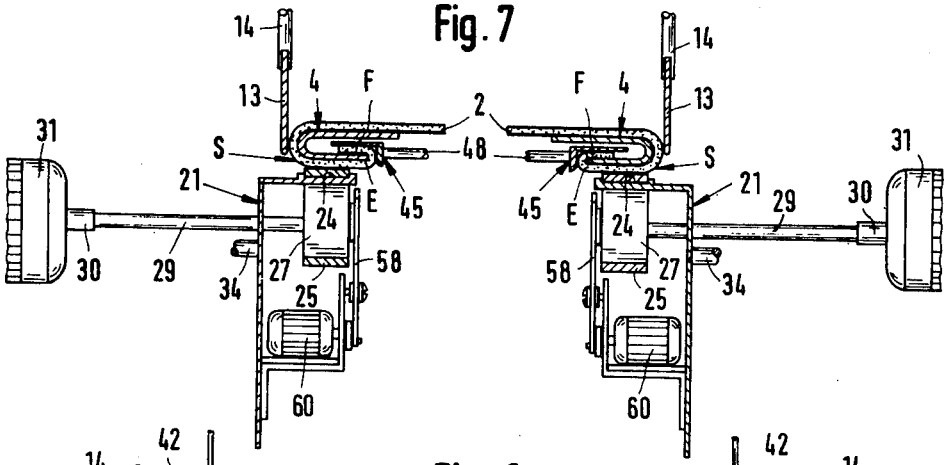
Figure 8:
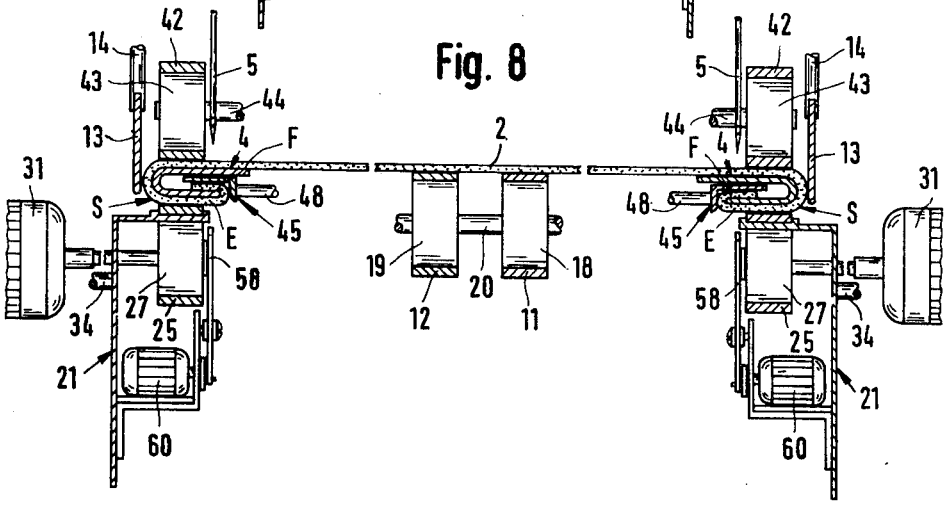

Referring to the drawings in particular, the invention embodied therein, comprises a machine for advancing a material web 2 into association with folding bars and for forming double tucks on the material and for thereafter feeding the material into association with a reciprocating needle 5, which is shown in FIGS. 2 and 8. The system is arranged on a frame 1, indicated in FIG. 1, and comprises, for the left and right edge strips of the material web 2, seen in feed direction shown by arrow V, two mirror-symmetrical parts, of which only the part for the formation of one double tuck S (FIGS. 7, 8, 9) on the left lateral edge of the material web 2 is represented in FIGS. 1 and 2. As the right part of the system is mirror-symmetrically identical with the left part, only the construction of the left part is described.

A bracket 3 is fastened to the frame 1 and it carries a folding bar 4 which is mounted by its one end and whose other end extends freely to a location just before the needle 5 of the sewing machine 6 (FIG. 2). The folding bar 4 is bent downwardly and toward the center of the material web 2 in U-shape configuration and comprises the legs 7 and 8. A yoke or web 9 interconnects the legs 7 and 8 and defines the fold line for the first tuck edge at the strip 10 (FIGS. 3, 4) of the material web 2.

For the purpose of first folding the edge strip 10 of the material web 2 resting on the folding part or bar 4 and on the auxiliary conveyor belts 11, 12 (FIG. 8) arranged between the left and the right part of the system, downward by 90° at the longitudinal edge formed by yoke 9 of folding bar 4, a vertically movable folding stave 13 is provided which is fastened to the piston rod 14 of a fixed compressed air cylinder comprising the connections 16 and 17.

A set of four auxiliary conveyor belts 11, 12 are disposed to engage the central portion of the material web 2 and they are tensioned around guide rollers 18 and 19, one of which is provided at each of the front and rear ends of the transport path on a shaft 20 for each mounted in frame 1. The front pulling guide rollers 18 and 19 are driven in a known manner (not shown). The lower auxiliary conveyor belts 11, 12 may have upper conveyor belts associated with them as needed, if a plier type transport should be necessary in the central zone of the material web 2.

A fold slide 21, movable in a horizontal direction under leg 8 of the folding bar 4 perpendicularly to the longitudinal edge of the folding bar 4 formed by yoke 9 is provided, to turn the downwardly folded edge strip 10 over by another 90°. The fold slide 21 forms an L-shape cross-section with the legs 22 and 23. The upper section of an endless conveyor belt 25 is guided for entrainment upon transverse displacement of the fold slide 21 in a slot 24 in leg 23 of the fold slide 21, which slot extends parallel to the feed direction V. The conveyor belt 25 is tensioned around guide rollers 26 and 27, of which one roller 26 is rotatable and axially displaceable on an axle 28 fastened to frame 1, and the other roller 27 is mounted on the driven shaft 30, in part designed as square bar 29, of a gear motor 31 secured on frame 1, and it is displaceable in axial directions of the driven shaft 30. The free ends of an axle 28 and a square bar 29 of a shaft 30 carry a limiting flange 32 and a limiting flange 33, respectively.

The fold slide 21 is fastened for the first folding of the edge strip 10 to piston rods 34, 35 of two compressed air cylinders 36, 37 which are mounted on frame 1. The cylinders 36 and 37 each have two connections 38, 39 and 40, 41, respectively. The fold slide 21 is displaced by a piston within respective compressed air cylinder 36 and 37 perpendicularly to the displacement direction V. The conveyor belt 25 is entrained in the slot 24 by the guide rollers 26, 27 sliding on the axle 28 or on the square bar portion 29 of shaft 30 so that, as is shown in particular in FIGS. 5–8, the conveyor belt 25 is moved under the lower leg 8 of the folding bar 4.

An upper conveyor belt 42, which is tensioned about two guide rollers 43 (only the rear guide roller 43 being represented in FIGS. 1 and 2) cooperates with the lower conveyor belt 25. The rear guide roller 43 is fastened on a shaft 44 which is driven by a drive in a known manner (not shown), while the front guide roller (also not shown) is rotatably mounted on a fixed axle, similar to roller 26. The guide rollers 27 and 43 are driven at the same speed so that the material web 2 is guided by the conveyor belts 25 and 42.

A folding plate 45, which consists of an L-shape bar with the legs 46 and 47 is fastened on the piston rod 48 of two compressed air cylinders 49, but only one is shown in FIG. 1. The compressed air cylinders 49 have connections 50 and 51 at respective ends for admission and discharge of the control fluid. Through them, the folding plate 45 is inserted by its leg 46 between the legs 7 and 8 of folding bar 4 for the formation of the inner tuck portion F.

Two compressed air cylinders 52, mounted on frame 1, (only one is represented in FIG. 1), serve for the vertical lift movement of the folding plate 45. Piston rods 53 of the air cylinders 52 carry a bracket 54. The compressed air cylinder 52 has connections 55 and 56 and is fastened to frame 1 by means of a bracket 57.

On leg 22 of the fold slide 21, in the zone of the end thereof away from the sewing station 6, auxiliary feed means comprising a plate 58 is provided, which is driven briefly and faster than the conveyor belts 25 and 42. The upper portion of plate 58 engages at the tuck portion E of the material web 2, and it is serrated and is movable through a cutout 59 in leg 23 of the fold slide 21 upwardly into engagement with the portion E of tuck S, which is folded around the leg 8 of the folding bar 4. Plate 58 is driven from a motor 60 which is arranged on a bracket 61 fastened to leg 22 of fold slide 21. On the free end of the motor shaft 62, passed through a bore of bracket 61, a crank 63 is fastened, whose crank pin 64 extends into a bore of the auxiliary feed plate 58. The auxiliary feed plate 58 has a slot 65 through which is passed a clamp screw 66 turned into the bracket 61. Due to this arrangement, the auxiliary feed plate 58 executes a quadrangular movement in a vertical plane during rotation of the motor shaft 62.

Alternatively, instead of the feed plate 58, there could be used a feed roller connected to the shaft 62 driven via a freewheel briefly and faster than the conveyor belts 25 and 42. Also, an auxiliary conveyor belt (not shown) which is passed over guide rolls (not shown) which are also driven briefly and faster than the conveyor belts would comprise satisfactory auxiliary drive means.

When working critical materials, as for example a smooth fabric of high resilience, it very easily happens that the parts of the double tuck S shift during pull-off from the folding bar 4, and during feeding to the sewing station 6, and therefore, again protrude over the terminal edge K of the material web just before the sewing station. In this case, it is advantageous to arrange in the zone of the end of the folding station toward the sewing station, at releatively short distance from the sewing station 6, an additional auxiliary feed plate for the double tuck S which, like the auxiliary feed plate 58, may be designed as feed roller with a freewheel, or as an auxiliary conveyor belt and which is likewise driven briefly and faster than the conveyor belts 25 and 42. Expediently, this auxiliary feed plate is controlled dependent on the workpiece, for example, by a photocell arranged at a certain distance before the sewing station 6, through a known signal amplifier. As soon as the terminal edge K of the material web has passed the photocell, the additional auxiliary feed plate is connected via the signal amplifier. The connected time is determined by an electric timing element. The auxiliary feed plate shifts the parts of tuck S protruding over the terminal edge K of the material web 2 just before the sewing station 6 so that they are flush with the terminal edge K and, hence, are sure not to stand out over the terminal edge K of the material web after stitching. The front and rear auxiliary feed plates can be connected in either one alone or both together as needed.

It should also be mentioned that the control of the motors and of the sewing machine can occur by a combination of manually operable, work-dependent switching means. The connected time of the motors 60 for the drive of the auxiliary feed plates 58 is determined by an electric timing element, and the compressed air supply of the compressed air cylinders 15, 36, 37, 49 and 52 controlling the folding tools is effected by a known electric program control system via electromagnetic valves with the use of limit switches (not shown).

Figure 3:
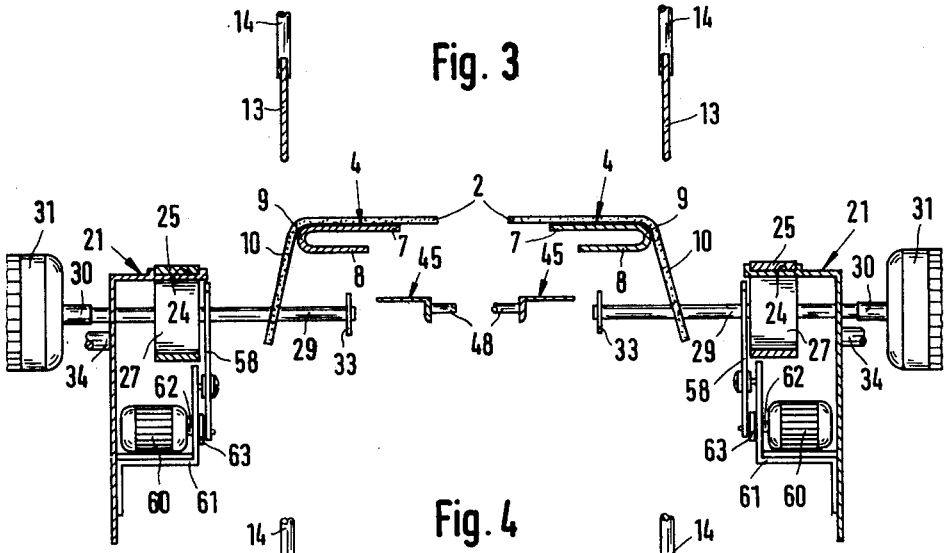
FIGS. 3–8 are partial sectional views taken transverse to the folding bar indicating the operating mechanisms for forming a double tuck on each side of the material being fed and the various stages of operations for accomplishing this.

Assuming the parts of the system, as shown in FIGS. 1 and 3 to be in their starting position, the apparatus works as follows: From a cross-cutting station, in which the workpieces are pulled off of a material supply roll and cut to their length, and which may precede the system for forming the double tucks S at the material web 2, the web 2 cut to length is advanced either by its own feed device or by the auxiliary conveyor belts 11 and 12, seen in FIG. 8. The belts 11 and 12 extend from the cross-cutting station to behind the sewing station 6 and are driven, synchronously with the conveyor belts 25 and 42, into their required position, according to FIGS. 1 and 3, for the forming of a double tuck S at both edge strips 10 (FIGS. 3 and 4), with the lateral edges parallel to the outer edges of the folding bars 4 resting thereon into the folding station, the edge strips 10 having dropped down loosely over the outer edges of the folding bars 4, as seen in FIG. 3.

Figure 4:
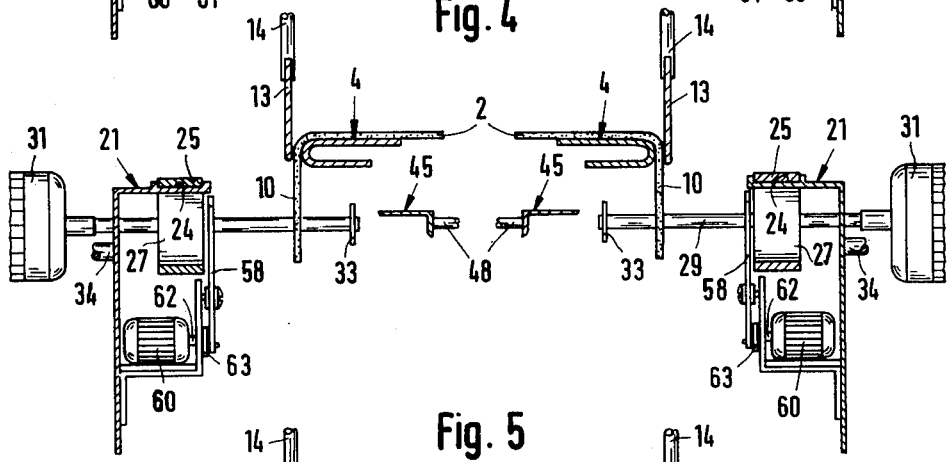

By supply of compressed air through connection 16 of compressed air cylinders 15, folding staves 13, fastened to piston rods 14, are moved downward by 90° alongside the outer longitudinal edges formed by yoke 9 of fixed folding bars 4, and determine the first fold edge of the tucks S, as best seen in FIG. 4. Thereupon, the pistons of the compressed air cylinders 36 and 37 are pressurized with compressed air via the connections 38 and 40, whereby, fold slides 21, fastened to piston rods 34 and 35, are shifted toward the center of material web 2 with their leg 23 under leg 8 of folding bars 4. The upper reach of conveyor belts run in the slot 24 in leg 23 of fold slides 21. Conveyor belts 25, together with guide rollers 26 and 27, which are axially displaceable on axles 28 or respectively on the square portion 29 of shafts 30, are taken along with fold slides 21, to fold the edge strips 10 of web 2 over by another 90°.

To obtain a uniform contact pressure of the conveyor belts on the entire tuck length, known contact rolls may be arranged between the upper and lower sections of the conveyor belts 42 between the front and rear guide rolls 43.

Figure 5:
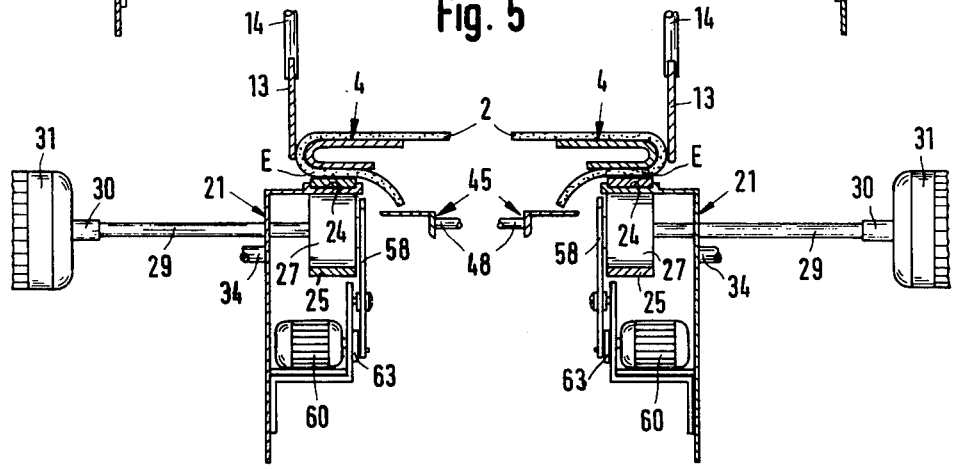

As seen in FIG. 5, the conveyor belts 25 occupy in the fold end position, which is determined by the run-up flanges 32 and 33 for the guide rollers 26 and 27, a position under the folding bars 4 in which they maintain the first tuck portion E pressed against the leg 8 of folding bars 4, while the conveyor belts 42 cooperating with the lower conveyor belts 25 press the material web 2 against the leg 7 of folding bars 4.

Figure 6:
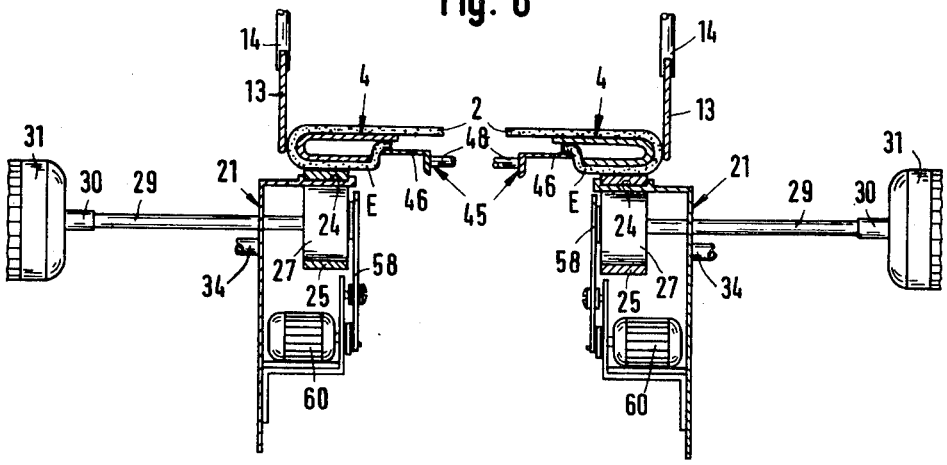

Following the formation of the first tuck portion E, the interior portion F of the tucks S is pushed, by means of folding plates 45, between legs 7 and 8 of U-shape folding bars 4 (FIGS. 6 and 7). By a supply of compressed air through connections 55 of compressed air cylinders 52, to whose piston rods 53, brackets 54 with compressed cylinders 49, and folding plates 45 are fastened, the latter are moved first upwardly with their leg 46 into a horizontal plane lying between legs 7 and 8 of folding bars 4. The free edges of the material web 2 is also lifted, as shown in FIG. 6. Thereafter, the free edges of web 2 thus lifted are inserted by means of folding plates 45, or respectively, their legs 46, by supply of compressed air through the connections 50 of compressed air cylinders 49 between legs 7 and 8 of folding bars 4 (see FIG. 7).

To make sure that the inner tuck portions F lie flat and evenly after insertion, the inserting movement of the folding plates 45 is repeated once and, if necessary, several times, by supplying compressed air to cylinders 49 alternately through connections 50 and 51.

Folding staves 13, fold slides 21 with conveyor belts 25, and folding plates 45 remain for the duration of the feeding of material web 2 to sewing station 6 in the fold-end position shown in FIGS. 7 and 8.

When the folding process is completed, gear motors 31, which drive guide rollers 27 via known drive connections (not shown) synchronously with guide rollers 18, 19, 43, are switched on by actuation of a starter switch. Then material web 2, gripped in plier fashion by conveyor belts 25 and 42 in the zone of the tucks S, is supplied, supported in the middle by the auxiliary conveyor belts 11 and 12, to sewing station 6, where the tucks S are fixed by seams N.

Simultaneously with the motors 31, motors 60 are switched on briefly, the connected time being determined by an electric timing element. Through crank 63 secured on driven shaft 62 of motors 60 and through crank pins 64, auxiliary feed plates 58, guided pivotably and for longitudinal displacement by means of clamp screws 66 and slot 65, are moved in a vertical direction on a path substantially corresponding to a quadrangle, coming into engagement with the portion E of the tucks S, and, because their shifting movement is faster than the conveying movement of conveyor belts 25 and 42, they shift any tuck portions that might be protruding over the terminal edge K of material web 2 in the feed direction V so that they are flush with the terminal edge K. As has been mentioned above, an additional auxiliary feed plate 58 for each tuck S may be arranged in the zone of the end of the folding station toward the sewing station at relatively short distance before the sewing station. The auxiliary feed is started briefly just before the sewing station for a further feeding action, as needed.

After the seams N are formed, conveyor belts 11, 12, 25 and 42 are stopped by switching the motors 31 off. From the fold-end position, according to FIG. 8, the folding staves 13 are moved back to the starting position according to FIG. 3 by the supply of compressed air through the connections 17 of compressed air cylinders 15. Folding plates 45 are moved by supply of compressed air via the connections 51 of compressed air cylinders 49 and, brackets 54 are moved by the supply of compressed air via connections 56 of compressed air cylinders 52, and fold slides 21 with the conveyor belts 25 are moved by pressurization of the pistons of the compressed air cylinders 36 and 37 via connections 39 and 41, whereupon, the folding station can be charged with the material web to be processed next, and the described cycle is then repeated.

While a specific embodiment of the invention has been shown and described in detail to illustrate the application of the principles of the invention, it will be understood that the invention may be embodied otherwise without departing from such principles.

What is claimed is:

1. A system in sewing installations for the forming of a double tuck at the cut edges of flat material webs, and for feeding of a material web, for example, to a sewing station, comprising means defining a folding station adjacent the sewing station including a stationary U-shape folding bar having spaced apart legs and a web connecting the legs at their one ends, a fold slide and means cooperating therewith for moving said slide to fold the material over the connecting web end of the folding bar, a folding plate, means mounting said folding plate for movement in two mutually perpendicular planes and in a path in which it is inserted into the space between said legs of said folding bar, and a plurality of conveyor belts arranged in opposite pairs and clamping the material web between pairs, the improvement comprising at least one movable conveyor belt engaging at the material in the vicinity of the tuck portion to move the material in a feed direction, and auxiliary feed means engageable with the material for driving the material briefly and at a rate faster than said conveyor belts engaging the material in the vicinity of the tuck portion.

2. A system according to claim 1, wherein said fold slide has a guide slot, said conveyor belt being guided in said guide slot.

3. A system in sewing installations for the forming of a double tuck at the cut edges of flat material webs and for feeding of a material web, for example, to a sewing station, comprising means defining a folding station adjacent the sewing station including a station U-shape folding bar having spaced apart legs and a web connecting the legs at their one ends, a fold slide cooperating therewith for folding the material over the connecting web end of the folding bar, a folding plate, means mounting said folding plate for movement in two mutually perpendicular planes and in a path in which it is inserted into the space between said legs of said folding bar, and a plurality of conveyor belts arranged in opposite pairs and clamping the material web between pairs, the improvement comprising at least one movable conveyor belt engaging at the material in the vicinity of the tuck portion to move the material in a feed direction, and auxiliary feed means engageable with the material for driving the material briefly and at a rate faster than said conveyor belts engaging the material in the vicinity of said tuck portion, said auxiliary feed means comprising an auxiliary feed plate, drive motor means connected to said feed plate adjacent one end for oscillating this end of said plate, said plate having a slot intermediate its length and a fixed member engaged in said slot so that said plate forms a quadrangular movement in a vertical plane, said fold slide having a cut-out through which said plate is movable to engage the material at the location adjacent the fold of the material over the leg of the folding plate.

4. A system according to claim 3, wherein said folding plate is driven such that it moves several times in succession into engagement with the material during a tuck formation.

5. A method of advancing material to a sewing needle which includes at least one edge having a double tuck and using a U-shaped folding plate about which the material is tucked, comprising positioning the material on the folding plate and folding it downwardly over the connecting web of the U-shape portion, thereupon, folding it substantially horizontal into engagement with the lower leg of the folding plate, subsequently folding the free end over the edge of the lower leg of the U-shape folding plate and into the space between the legs thereof, engaging at least one side of the material along a considerable portion of its length and advancing it in a feeding direction toward the sewing machine needle and, at least directly before it is fed into the needle, advancing the material by separate feed means which is engaged with the opposite side of the material adjacent the end which is folded over the leg of the U-shape folding bar to advance it at a speed greater than the traveling speed of the material.

6. A method according to claim 5, wherein the material is clamped from opposite sides and is fed by first feed means to the sewing machine and is engaged intermittently and only briefly by the separate feed means to advance a portion of the material adjacent the tucked-in edge so that the tucked-in edge remains even with the remaining edge portion of the material.

7. An apparatus for forming a double tuck on a lateral edge of the length of a flat material web, comprising at least one U-shape folding bar for supporting the web along an area spaced from the lateral edge of the material, said bar having a lower leg and an upper leg and a yoke portion interconnecting said upper and lower legs adjacent their one ends, a stave engageable with the material to deflect it over the yoke portion of the folding bar, means mounting said stave for upward and downward motion adjacent said folding bar in a plane spaced from said yoke portion by the thickness of said web and movable downwardly toward said yoke for folding the lateral edge of the material about said yoke portion, a fold slide having a top slide portion, means mounting said fold slide for movement in a transverse direction to position the top fold slide adjacent to and spaced from the lower leg by the thickness of said web for folding the lower leg by deflection against the bottom of said lower leg, a folding plate having a plate portion engageable between the legs, means mounting said folding plate for upward and downward movement in a plane adjacent to and spaced from the edge of the lower leg by the thickness of said web in order to deflect the material around the lower leg being movable in a transverse direction into the space between the legs for deflecting the material into the space to form a tuck, at least one conveyor belt having a reach train to run in contact with a portion of the material on said fold bar and to move it in a feed direction, and at least one auxiliary feed device engageable with the material adjacent the tucked end for briefly feeding the material at a speed distinct from the feed of the conveyor belt.

8. An apparatus according to claim 7, wherein said slide top portion includes a slot, said conveyor belt having its upper reach movable along said slot, said slide having an opening through which said auxiliary feed means engages the material.

9. An apparatus according to claim 7, including at least one second conveyor engageable with the material on a side opposite from said at least one conveyor belt.

10. An apparatus to claim 7, wherein said stave comprises a plate extending substantially the length of said material, and said means mounting said stave includes a fluid-piston and cylinder combination connected to said stave for moving it upwardly and downwardly.

11. An apparatus according to claim 7, said means mounting said fold slide including a slide fluid-piston and cylinder combination connected to said slide for displacing said slide laterally.

12. An apparatus according to claim 7, said means mounting said folding plate including a first fluid-piston and cylinder folding plate drive connected to said folding plate for moving it horizontally and a second fluid-piston and cylinder combination fold slide drive connected to said fold slide for moving it vertically.

* * * * *